United States Patent [19]

Cook

[11] Patent Number: 4,517,064

[45] Date of Patent: May 14, 1985

[54] ELECTROLYTIC CELL

[75] Inventor: Melvin S. Cook, Tucson, Ariz.

[73] Assignee: Duval Corporation, Tucson, Ariz.

[21] Appl. No.: 535,235

[22] Filed: Sep. 23, 1983

[51] Int. Cl.[3] ..... C25B 1/00

[52] U.S. Cl. ..... 204/105 R; 204/107; 204/222; 204/260; 204/261

[58] Field of Search ..... 204/222, 259, 261, 260, 204/296, 106–108, 105 R, 272–273, 257

[56] References Cited

U.S. PATENT DOCUMENTS

| | | | |
|---|---|---|---|
| 734,950 | 7/1903 | Quedenfeldt | 204/261 |
| 803,543 | 11/1905 | Betts | 204/222 |
| 870,915 | 11/1907 | Vreeland | 204/253 |
| 926,492 | 6/1909 | Jean | 204/260 |
| 1,287,156 | 12/1918 | Whitehead | 204/253 |
| 1,378,939 | 5/1921 | Cole | 204/261 |
| 1,403,463 | 1/1922 | Allingham | 204/261 |
| 1,457,791 | 1/1923 | Norris et al. | 204/261 |
| 1,535,378 | 4/1925 | Richter et al. | 204/261 |
| 2,204,982 | 6/1940 | Dähling | 204/260 |
| 3,767,542 | 10/1973 | Carlson | 204/261 |
| 3,796,646 | 3/1974 | Zambon | 204/273 |
| 3,801,488 | 4/1974 | Okuhara et al. | 204/260 |
| 4,025,400 | 5/1977 | Cook et al. | 204/273 |
| 4,036,729 | 7/1977 | Patil et al. | 204/296 |

*Primary Examiner*—R. L. Andrews
*Attorney, Agent, or Firm*—Delmar L. Sroufe

[57] ABSTRACT

An improved apparatus and process for electrolytically producing a particulate crystalline metal product having limited adherence to the surface of a cathode, comprising a vertically elongated cathode, at least one vertically elongated anode spaced from said cathode, a vertically elongated permeable diaphragm disposed between said anode and cathode having a mesh member disposed adjacent to the surface of said diaphragm nearest said cathode, agitating said anode to substantially reduce the polarization voltage of said anode, and agitating said cathode to dislodge a portion of said crystalline product from said cathode by engaging said product with said mesh member.

6 Claims, 7 Drawing Figures

11
11
20
9
2
3
4
2
3
4
4
8
17
20
9
11
11
9

11
9
30
32
31
10
21
12
7
6
5
4
8
3
2
16
17
33
34
13

ELECTROLYTIC CELL

BACKGROUND OF THE INVENTION

This invention relates to apparatus and processes for electrolysis usage, and more specifically to apparatus and processes for electrolytically producing a metal product.

Prior art electrolytic cells for electrowinning metal products have commonly consisted of closely spaced anode and cathode plates immersed in electrolyte. The planar surfaces of the electrode plates are generally spaced close together to minimize resistance to the flow of current through the electrolyte between the plates. However, in the electrowinning process, the depositing or plating of product is never uniform across the plates and some minimum clearance is required to avoid a short circuit contact between the cathode and anode. In the production of particulate metal products as taught in U.S. Pat. No. 4,025,400, the plates must be spaced sufficiently far apart to allow for crystalline dendritic growth on the cathode and provide sufficient space to accommodate apparatus for removal of the product while the cell is in operation. In the aforementioned method of producing a crystalline product, a relatively high current density is required to achieve the desired loosely adhering dendritic crystalline growth on the electrode. This high current density, combined with high voltages between the electrodes, results in high resistance heating of the electrolyte with attendant inefficient utilization of power in electrowinning.

For the hydrometallurgical recovery of metals from ores or ore concentrates using a chloride system, as taught, for example, in U.S. Pat. No. 3,785,944, insufficient stirring of electrolyte causes chlorine gas to evolve. Chlorine gas is harmful to the anode material of the cell as well as the metallic and plastic parts associated with the cell. This results in high maintenance costs to repair any parts damaged by the corrosive atmosphere, since all adjacent cells must be shut down to allow access to a damaged part and to avoid electrical hazard to the maintenance personnel.

Additionally, the partial envelopment of the anode by very small gas bubbles in an electrolysis process results in increased cell voltage. This difference in cell voltage with and without the gas bubbles on the anode is called "polarization" voltage. Prior art cells are generally subject to polarization voltage and their overall cell voltage could be reduced by eliminating the gas bubbles on the anode.

Prior art cells embodying the invention of U.S. Pat. No. 4,025,400 for making particulate metal crystals employ a mechanical arm to sweep across the area adjacent to the surface of the cathode for the purpose of mechanically limiting the growth of crystalline dendrites by dislodging some of the crystalline product from the cathode. This dislodged product then falls to the bottom of the cell for recovery and, generally, later processing. These mechanical arms have proven to be somewhat unsatisfactory in long-term service because some of the crystals adhere to the cathode with the result that the cathode must be periodically removed and cleaned to remove the accumulated adhering dendrites. Other mechanical techniques, such as employing a vibrating or oscillating cathode as taught in Italian Pat. No. 1,400,758 to Piro et al., or means for periodically raising and dropping a cathode, as shown in British Pat. No. 13,499 to MacKay, have been suggested to remove crystalline growth from a cathode. These suggestions have not proved to be acceptable from a cost, maintenance or growth removal standpoint.

These and other limitations and disadvantages of the prior art are overcome by the present invention and an electrolytic cell and process is provided that minimizes cell voltage, power requirements and resistance heating, substantially eliminates anode polarization voltage, and in a preferred embodiment provides for more positive removal of crystalline product.

SUMMARY OF THE INVENTION

A preferred embodiment of the present invention comprises an electrolytic cell having a cylindrical cathode encircled by cylindrical anodes equally spaced about the cathode, and containing a tubular permeable diaphragm between the cathode and anodes, with a reduced operating voltage and an improved method for removal of dendritic crystals. In this preferred embodiment, a mesh member may be provided next to the diaphragm adjacent to the surface nearest the cathode and either the cathode or mesh member is agitated to provide circulation of the catholyte and improved removal of the dendritic crystals. In a presently preferred embodiment, six anodes are equally spaced about a cylindrical cathode.

The hexagonal spacing of the anodes around each cathode provides a lower resulting current density in the electrolyte between each anode and the cathode and hence a lower power requirement than would be required for a planar cell. The hexagonal anode configuration also allows for more compact spacing between anodes and cathodes with a resulting higher utilization of available cell space than with a conventional planar cell.

In an alternate embodiment of the present invention, an electrolytic cell is provided wherein the anode is agitated by a vibration means which substantially eliminates polarization voltage and thus provides a cell of lower operating voltage than a conventional planar cell.

In another embodiment of the present invention, an electrolytic cell comprising a cylindrical cathode encircled by a permeable tubular diaphragm which is encircled by two or more cylindrical anodes equally spaced from each other and equally spaced from the cathode is provided.

Also an embodiment of the present invention is an electrolytic cell with an improved means for removal of dendritic crystals.

The application of this invention to electrolysis systems for electrowinning metal products is generally feasible with respect to the transition metals and group IB and IIB metals as conventionally arranged in the periodic table of the elements. Such application is certainly feasible with respect to iron, cobalt, nickel, copper, silver, gold, palladium, zinc, platinum and cadmium. It is especially useful in chloride electrolysis systems for the production of particulate crystalline product as taught in U.S. Pat. No. 4,025,400.

It is an object of the present invention to provide an electrolytic cell of low operating voltage and power for use in electrolytic processes.

It is a further object of this invention to provide an electrolytic cell of compact arrangement for use in electrolytic processes.

It is also an object of this invention to provide an electrolytic cell for use in electrolytic processes with optimum anolyte flow at the point of highest anode current density so as to minimize electrolyte gas evolution.

It is still a further object of this invention to provide an electrolytic cell for use in electrolytic processes with agitation of the anode for substantially eliminating anode polarization voltage.

It is yet another object of this invention to provide an electrolytic cell for use in electrolytic processes with improved capability for positive removal of crystals from the cathode.

It is yet a further object of this invention to provide an electrolytic cell for use in electrolytic processes to recover metals from electrolyte containing a low concentration of such metals.

It is a specific object of the present invention to provide an apparatus for performing electrolysis, comprising a vertically elongated cathode, at least one vertically elongated anode spaced from said cathode, a vertically elongated permeable diaphragm disposed between said cathode and said anode, supporting means for said cathode and anode, first tank means acting in conjunction with and supporting said diaphragm for containing anolyte, and second tank means for supporting said first tank means and supporting means and acting in conjunction with said diaphragm for containing catholyte.

It is a further specific object of the present invention to provide a process for electrolytically producing a particulate crystalline metal product having limited adherence to the surface of a cathode, comprising providing a cathode, an anode, a diaphragm spaced from said cathode and disposed between said anode and cathode, and a mesh member disposed adjacent the surface of said diaphragm nearest said cathode, and agitating said cathode relative to said mesh member to effectively influence and contribute to the control of the crystalline product size and density as well as the structural competence of crystalline dendrites and to dislodge a portion of the dendritic growths from said cathode by engaging said mesh member with said growths.

It is yet a further specific object of the present invention to provide a process for electrolytically producing a product, comprising providing a cathode and anode, and agitating said anode to substantially reduce the polarization voltage of said anode.

It is therefore apparent that the present invention is one well adapted to obtain all of the advantages and objects hereinabove set forth, together with other advantages which will become obvious and inherent from a description of the apparatus and process themself. Accordingly, these and other features and objects of the present invention will become apparent from the following detailed description, wherein reference is made to the figures in the accompanying drawings.

IN THE DRAWINGS

DETAILED DESCRIPTION

Figure 1:
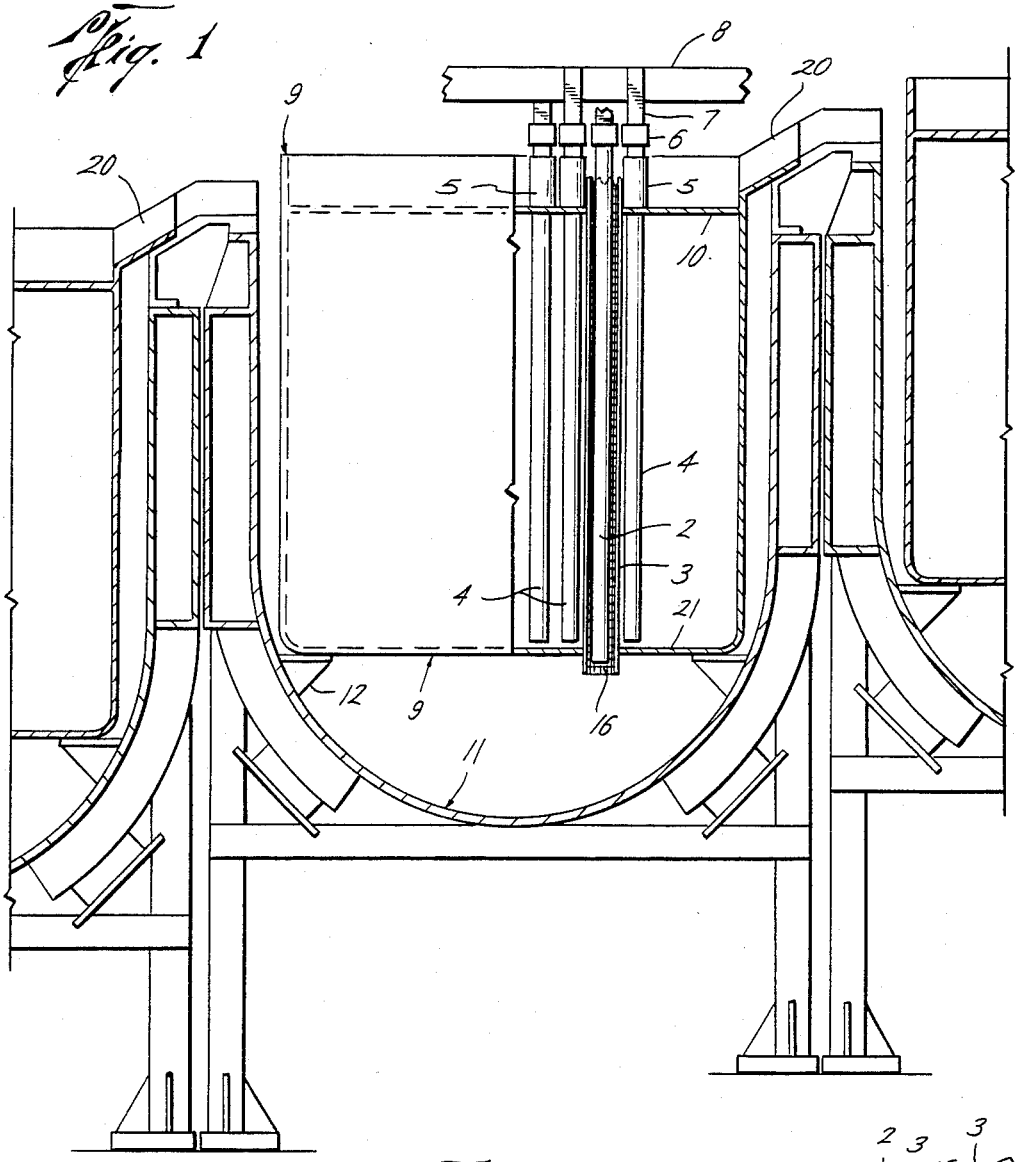
FIG. 1 is an end view, partially in cross section, of an apparatus employing one embodiment of the electrolytic cell of the present invention.

Referring now to FIG. 1, there is shown an apparatus employing one embodiment of the electrolytic cell of the present invention. For each cell, cathode 2 is encircled by diaphragm 3 and several anodes 4. Diaphragm 3 is located between cathode 2 and anodes 4. Anode sleeves 5 are shown, through which anode 4 passes, as are anode connectors 6 which connect the anodes 4 and anode bus bar extensions 7, which are also connected at their opposite end to an anode bus bar 8.

Mesh member 16 may be disposed adjacent to and may be attached to the interior surface of diaphragm 3. Mesh member 16 is used to agitate the catholyte and to mechanically rub against the crystalline growths on cathode 2 so as to break off at least part of the growth causing it to fall to the bottom of catholyte tank assembly 11 where it is collected, as discussed hereinafter.

The cell elements are shown in an anolyte tank assembly 9 which includes an anolyte tank top closure 10 from which sealingly attached anode sleeves 5 extend. The anolyte is contained in tank assembly 9 in contact with the anodes 4. Diaphragm 3 is sealingly attached to anolyte tank top closure 10 and anolyte tank bottom closure 21 to prevent the anolyte from passing from the anolyte tank assembly 9 through the annuli between each diaphragm 3 and openings provided therefor in the tank top 10 and bottom 21.

The anolyte tank assembly 9 is supported by anolyte tank supports 12 located in catholyte tank assembly 11. The catholyte solution is fed into the space on top 10 of anolyte tank assembly 9 and flows over the upper edges of diaphragm 3 down past cathode 2 into the space below and around anolyte tank assembly 9, within the catholyte tank assembly 11.

Figure 2:
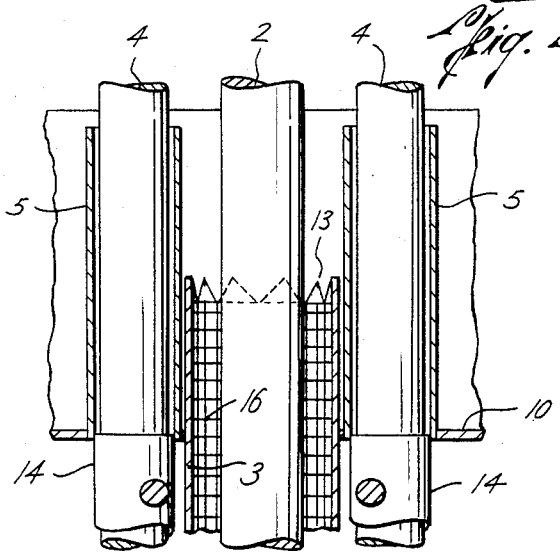
FIG. 2 is an enlarged side view of a portion, partially in cross section, of the apparatus shown in FIG. 1.

In FIG. 2, an enlarged portion of the apparatus depicted in FIG. 1 is shown. This figure shows in more detail top 10 of the anolyte tank assembly 9 (see FIG. 1) together with cathode 2, diaphragm 3, and anode 4. Anode supports 14 may be used to mechanically and electrically connect an outer graphite anode to an inner metallic tube which extends up to and connects with an anode bus bar extension 7, as hereinafter discussed in relation to a prototype cell embodying these concepts. Such supports may be eliminated by employing an anode made of only one material, such as for example, but not limited to, graphite, which extends up to and interconnects electrically and mechanically with anode bus bar extension 7. It is presently preferred that each anode 4 be made from a solid graphite rod.

The anode sleeve 5 and the diaphragm 3 are attached to tank top 10. Diaphragm weir 13 is used to provide a smooth flow of catholyte solution from the tank top 10 over the upper edge of the diaphragm 3 into the space between the diaphragm 3 and the cathode 2. The operating level of catholyte solution is normally about the same height as the midpoint of the notches of diaphragm weir 13, but may not be allowed to rise above the top of anode sleeve 5 as this would allow catholyte solution to spill into anolyte tank assembly 9.

Figure 3:
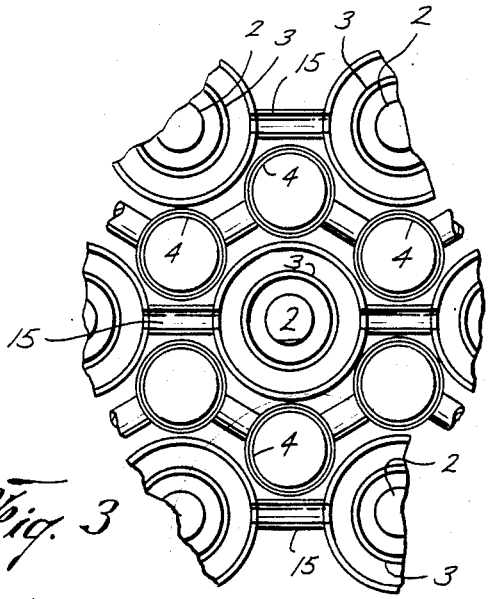
FIG. 3 is an enlarged top view, partially in cross section, of a different embodiment of a portion of the apparatus shown in FIG. 1.

Referring now to FIG. 3, cathode 2 is encircled by diaphragm 3. Anodes 4 are spaced around cathode 2 and diaphragm 3 in a hexagonal pattern so that, in the illustrated portion of the electrolyte cell, each anode 4 is shared by three cathodes 2. The catholyte solution is contained in the space between cathode 2 and diaphragm 3, while the anolyte solution is contained in the space between diaphragm 3 and anode 4.

The presently preferred hexagonal embodiment of FIG. 3 shows an alternate method of supplying catholyte to the space between diaphragm 3 and cathode 2, wherein cathode launder 15 supplies catholyte to this space. Launder 15 supplies catholyte to the area of diaphragm weirs 13 (see FIG. 2), as hereinbefore discussed. The use of such a cathode launder 15 eliminates the need for anolyte tank top 10 of FIG. 1 as the catholyte flows through launder 15 instead of on top 10 of anolyte tank 9 of FIG. 1.

Figure 4:
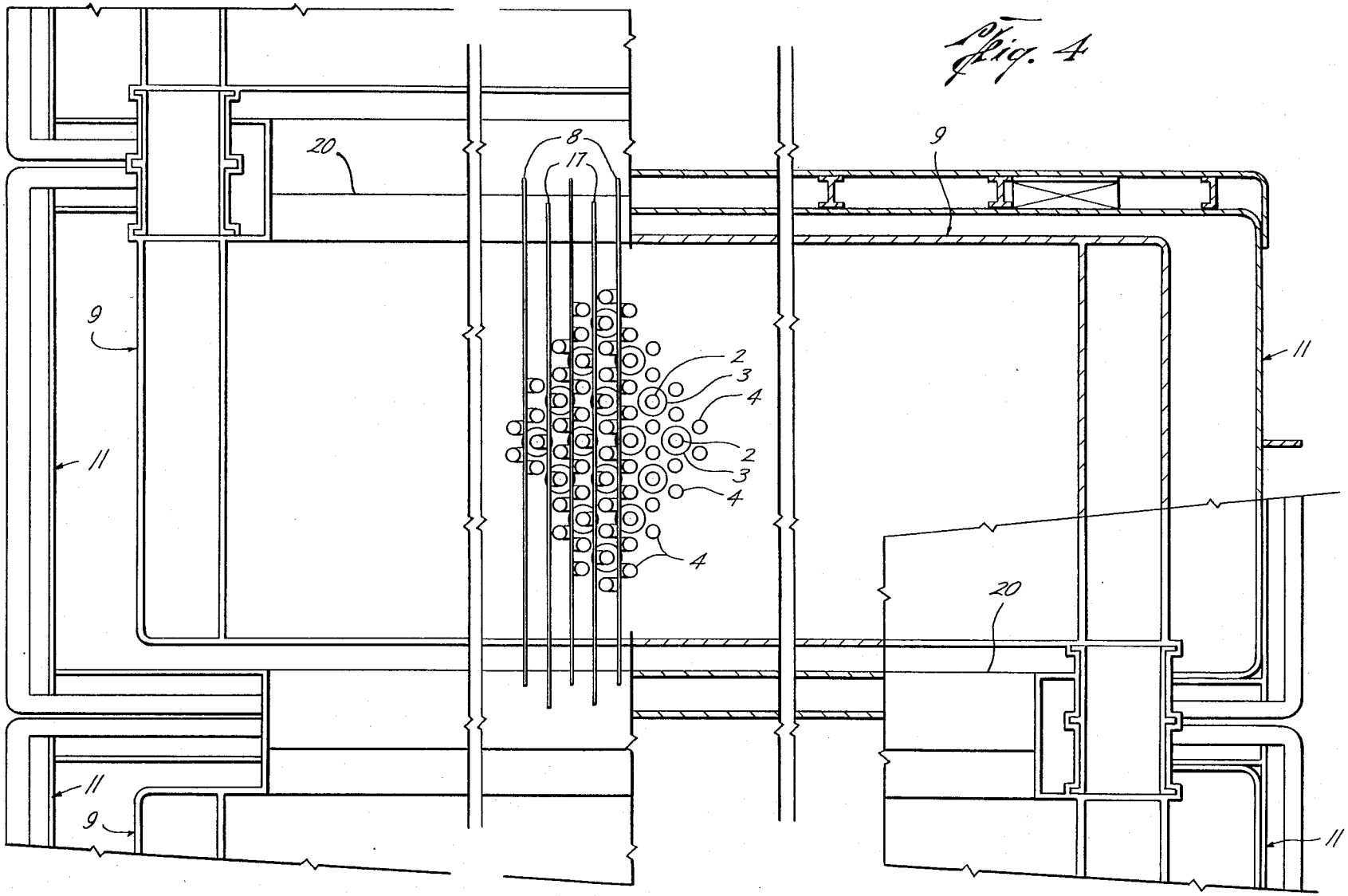
FIG. 4 is a top view, partially in cross section of the apparatus shown in FIG. 1.

Referring now to FIG. 4, there may be seen a top view of the apparatus shown in FIG. 1. Cathode 2, diaphragm 3, and anode 4 are again shown, as are anolyte tank assembly 9 and catholyte tank assembly 11. Anode bus bar 8 and cathode bus bar 17 are shown. Catholyte solution cross-feed connector 20 is shown which, by gravity feed, allows catholyte solution to flow from one catholyte tank assembly 11 to top 10 of adjoining anolyte tank 9, which is contained in the adjoining catholyte tank assembly 11, and thereby down through diaphragm 3 into adjoining catholyte tank assembly 11, on to the next top 10, etc., when catholyte tank assemblies 11 are horizontally arranged, as shown in FIG. 1.

Figure 5:
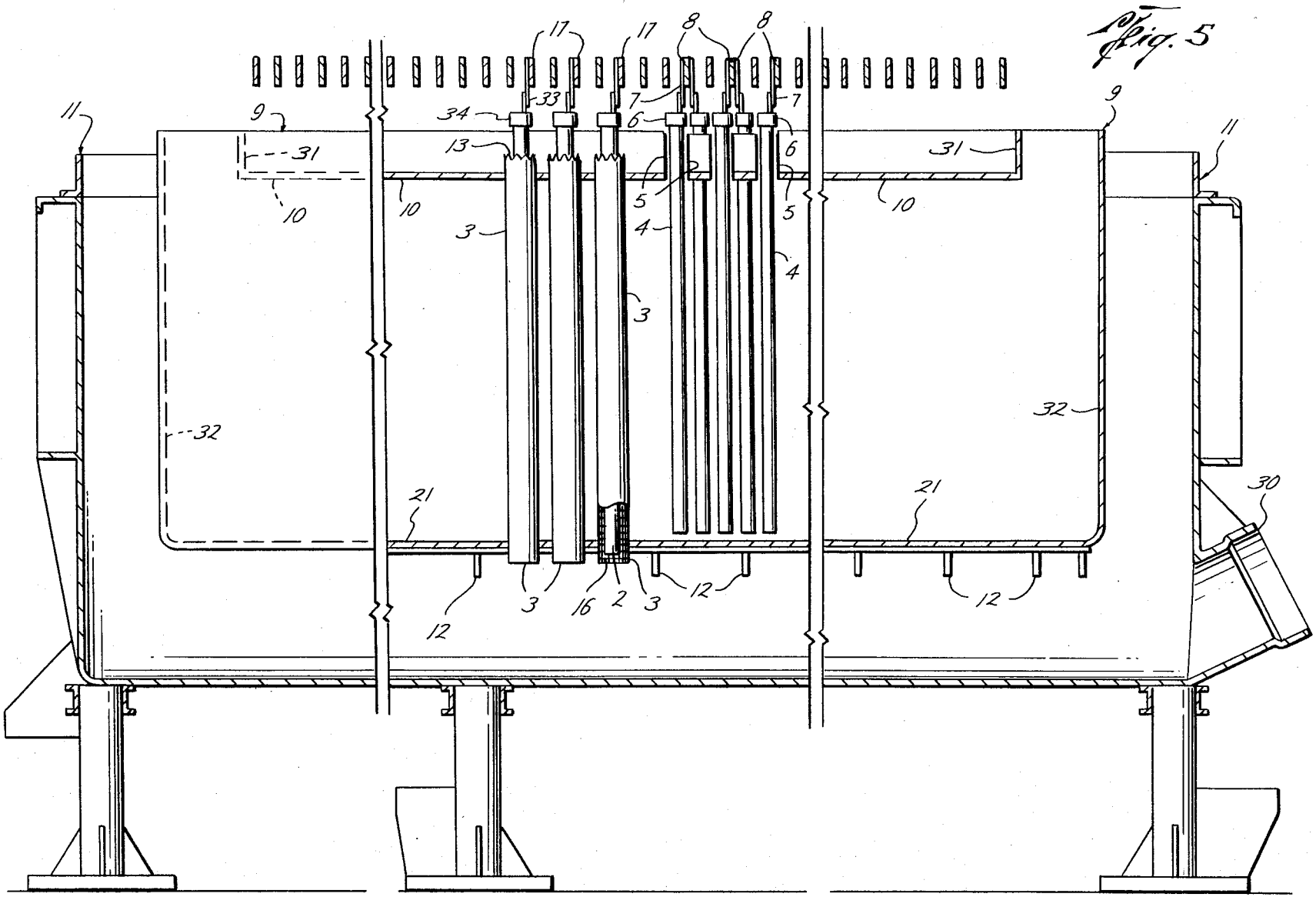
FIG. 5 is a side view, partially in cross section, of the apparatus shown in FIG. 4.

FIG. 5 shows a side view of the apparatus shown in FIG. 4. Cathode 2, diaphragm 3, mesh member 16, and anode 4 are again shown. Anolyte tank assembly 9 is held on anolyte tank supports 12 of catholyte tank assembly 11. Anode bus bar 8 is conductingly attached to anode bus bar extension 7 which is further conductingly attached to anode 4 by anode connector 6. Cathode bus bar 17 is conductingly connected to cathode bus bar extension 33 which is further conductingly attached to cathode 2 by cathode connector 34. As will also be apparent from the view of FIG. 5, catholyte tank outlet opening 30 is provided to allow a traveling conveyor belt (not shown) to pass out of catholyte tank assembly 11 after having passed below cathodes 2 and anolyte tank assembly 9. This belt collects the crystalline metallic product falling thereupon after such product has been mechanically removed from cathode 2, as taught in U.S. Pat. No. 4,025,400.

Catholyte solution flows onto top 10 of anolyte tank 9 where it is contained between two sides of tank 9 and two anolyte tank catholyte walls 31. Alternatively, the catholyte may flow through cathode launder 15, as shown in FIG. 3. The catholyte solution then flows over diaphragm weirs 13 down past cathode 2. The catholyte solution is kept separate from the anolyte solution below tank top 10 by the attachment of anode sleeve 5 and attachment of diaphragm 3 to tank top 10 or, alternatively, launder 15, as shown in FIG. 3. The catholyte solution below anolyte tank assembly 9 is kept out of the anolyte solution above tank bottom 21 by the attachment of diaphragm 3 to tank bottom 21.

The anolyte solution is pumped into the area adjacent the anolyte tank end wall 32 at one end of anolyte tank assembly 9 and removed from the corresponding area at the opposite end of anolyte tank assembly 9. Thus, the anolyte solution flows freely from one end of anolyte tank assembly 9 to the other end passing between anode 4 and diaphragm 3 and this flow path provides excellent mixing to prevent stratification zones in the anolyte tank assembly 9.

U.S. Pat. No. 3,785,944 teaches the electrolytic recovery of a metal through use of a chloride system, where a metal chloride produces a metal precipitate at the cathode and releases a chloride ion at the anode. U.S. Pat. No. 4,025,400 teaches an increased current density that allows the formation of dendritic metal crystals on the cathode that are removed by mechanical means.

The present invention may be used in a preferred embodiment for the recovery of dendritic copper in a chloride process wherein fresh catholyte is principally cuprous chloride. A portion of the cuprous ion is reduced at the cathode to metallic copper. Cuprous chloride, which is spent catholyte, is conveyed to the anode tank where it is, in turn, simultaneously oxidized at the anode to cupric chloride. This chloride process requires a diaphragm to keep the cuprous ion separate from the cupric ion but this diaphragm should be permeable to the chloride ion. Without the diaphragm, cupric chloride will redissolve the metallic copper deposited on the cathode.

The catholyte solution is kept at a slightly higher hydraulic level or head than the anolyte solution, so that in the event of any leakage past or through the diaphragm, the catholyte will leak into the anolyte and not the reverse which would dissolve copper crystals on the cathode.

During a continuous operation of the apparatus, pregnant leach solution from a hydrometallurgical process for the dissolution of metal from its ore or ore concentrate is introduced as the catholyte solution into the top 10 area of anolyte tank 9, or cathode launder 15, to then flow over diaphragm weir 13 and pass down the space between diaphragm 3 and cathode 2. As this occurs, current between the cathode and anode reduces the catholyte to produce a crystalline metallic product which loosely adheres to the cathode. This catholyte may then, by gravity feed, be transported to top 10 of an adjoining anolyte tank assembly 9 and catholyte tank assembly 11 when the tank assemblies are arranged horizontally as shown in FIG. 1. This gravity feed may continue from tank assembly 11 to tank assembly 11, as desired. The spent catholyte from the last tank assembly 11 is then collected and pumped into the anolyte tank 9 where it is oxidized by the electrolysis process and by utilization of chloride ions that have passed from cathode 2 through permeable diaphragm 3 to anode 4. The anolyte solution is also used sequentially in several tank 9 assemblies. The liquor discharged from the final anolyte tank 9 is returned to the hydrometallurgical process for use in further dissolution of metal from its ore or ore concentrate.

The anolyte liquor discharged to the hydrometallurgical process to assist in dissolving further metal, conventionally has a metal concentration of about half that of the concentration of metal in fresh catholyte, for a chloride process. This allows the chloride ion to actively assist in dissolving the metal from its ore or ore concentrate.

Repetition of the pattern of the hexagonal spacing of anodes 4 around cathode 2 and diaphragm 3 allows each anode to be utilized by up to three cathodes 2 (see FIG. 3). In turn, each cathode 2 has six anodes 4 available to foster more uniform crystalline growth. The spacing between diaphragm 3 and anode 4 may be minimized to reduce the electrolyte resistance between cathode 2 and anode 4. The substantially cylindrical cathode and tubular diaphragm depicted in FIG. 3 also provides a maximum fluid velocity at the narrowest distance between diaphragm 3 and anode 4 which is also the area of maximum current density. This allows for operation with a higher current density than in previous cells employing a chloride process, with substantially no chlorine gas evolution.

The distance between cathode 2 and diaphragm 3 is minimized to minimize electrolyte resistance, but must be sufficient to allow for proper dendritic crystal growth on the cathode as well as to provide space for a mechanical agitation means to remove these crystals from cathode 2. These "removed" crystals drop to the bottom of catholyte tank 11 and are collected on a conveyor belt (not shown) as discussed hereinbefore.

The minimization of spacing between cathode 2 and anode 4 reduces cell resistance and therefore cell voltage. Thus for the same power, a minimum spaced cell of the present invention may employ a higher current density than in a planar cell, which results in an improved crystalline metal product with no chloride gas evolution, when a chlorine process is employed.

Figure 6:
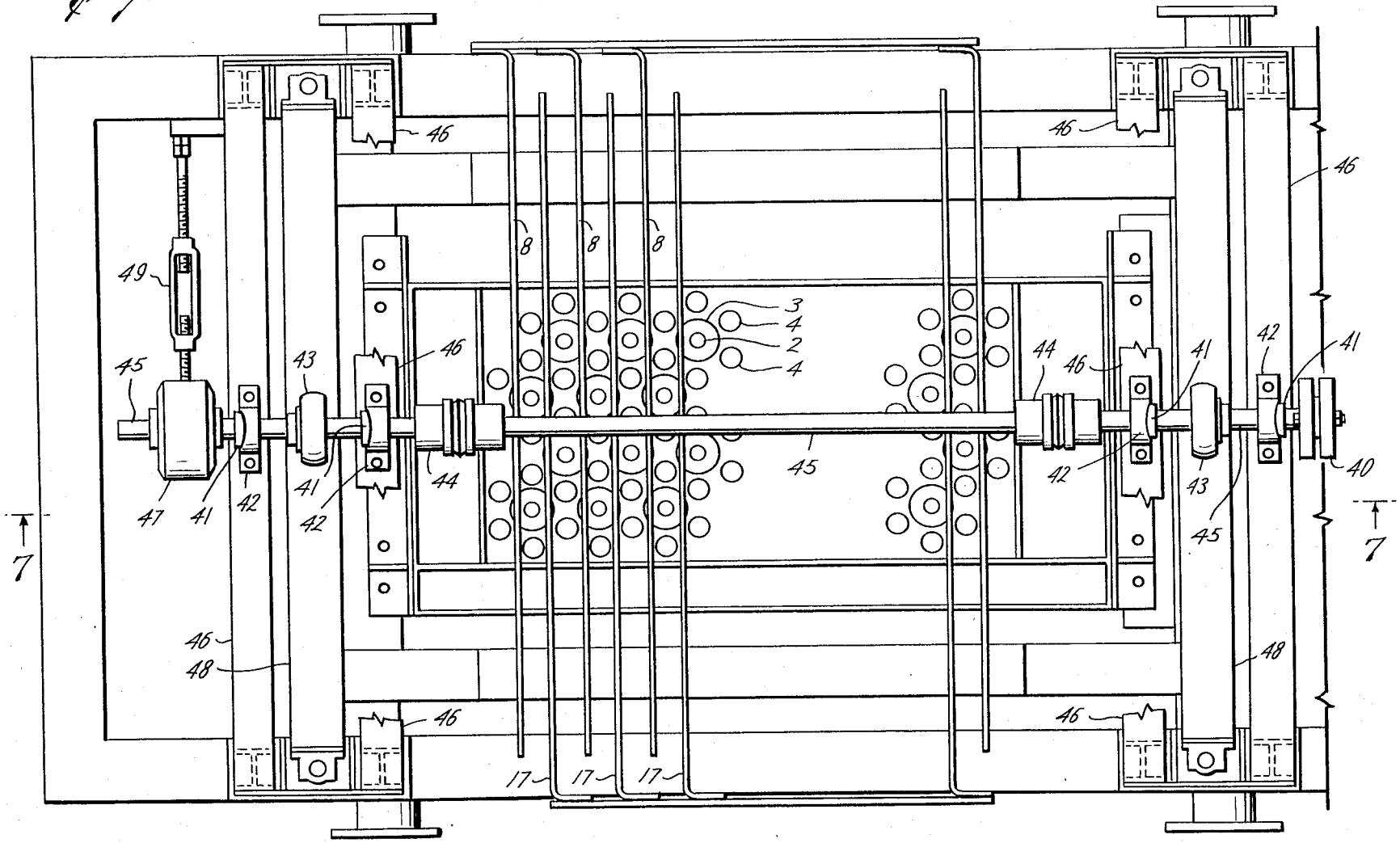
FIG. 6 is a top view, partially in cross section, of a different portion of the apparatus of FIG. 1.

Referring now to FIG. 6, there may be seen a top view of a different portion of the apparatus of FIG. 1. Cathode 2, diaphragm 3, anode 4, anode bus bar 8 and cathode bus bar 17 are again shown. Several shaft bearings 41, containing a shaft 45, are shown mounted in bearing holders 42. An eccentric bearing assembly 43 is shown between the two sets of bearings 41 at each end of the shaft 45. Shaft coupling joints 44 are also shown interconnecting the three sections of shaft 45. The bearing holder 42 is attached to and supported by mounting stand 46. Gear box 47 is mounted on shaft 45, attached to gear box side holder 49, and suitably mounted to mounting stand 46 (see FIG. 7). Lifting bar 48 is also shown. Also shown in hub 40 for a counterweight 54 (see FIG. 7), on shaft 45.

Figure 7:
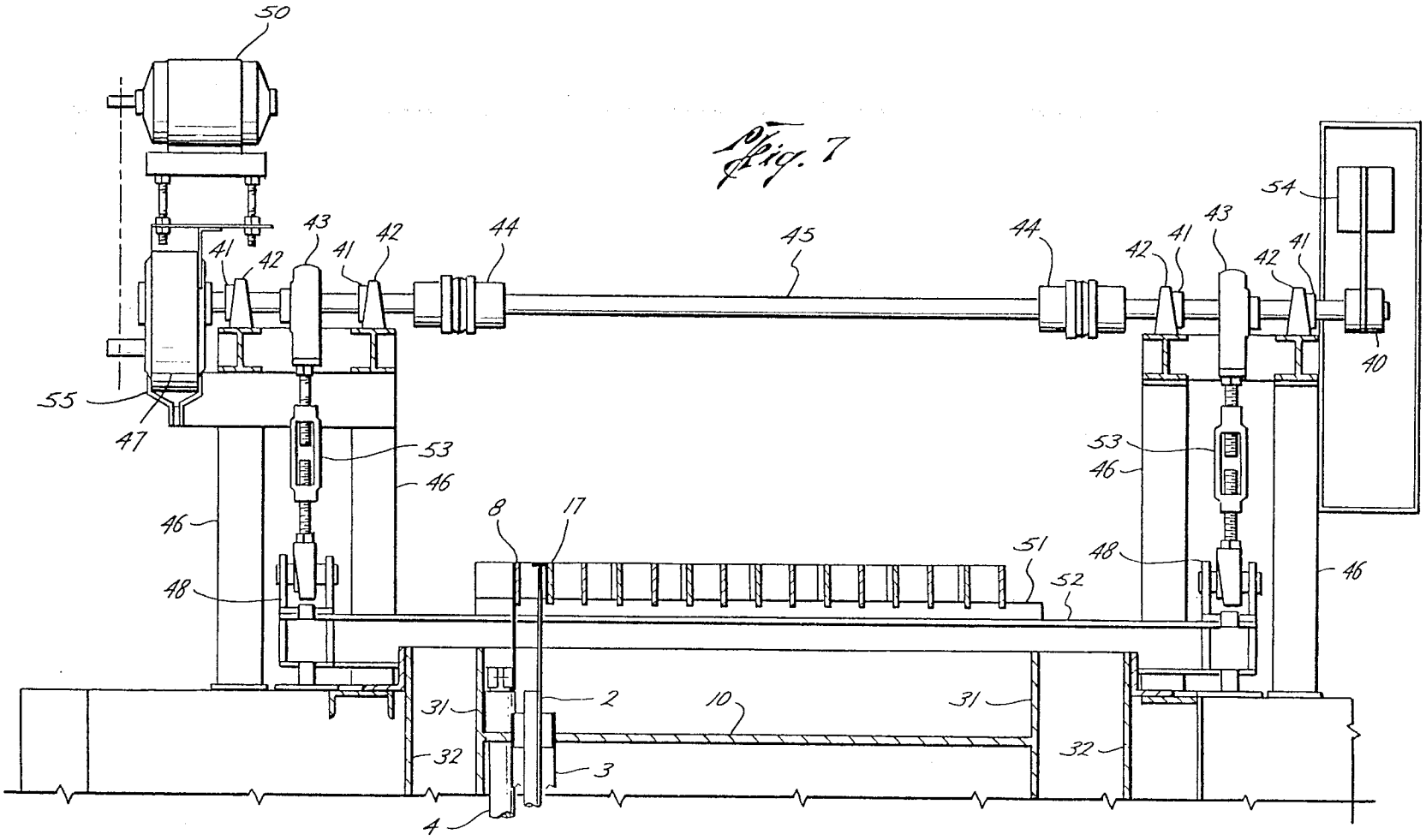
FIG. 7 is a side view, partially in cross section, of the apparatus shown in FIG. 6, taken generally along line 7—7 of FIG. 6.

Referring now to FIG. 7, a side view of the apparatus of FIG. 6 is shown. Motor 50 is attached by suitable means to drive gear box 47 which, in turn, rotates shaft 45 at a predetermined speed. Also shown are shaft coupling joints 44, shaft bearings 41 and shaft bearing holders 42 mounted on mounting stand 46. Gear box mounting member 55 is shown supporting gear box 47 and is attached to mounting stand 46. Also shown is counterweight 54 attached to counterweight hub 40 which is mounted on shaft 45.

Cathode bus bar 17 and anode bus bar 8 are shown supported by an insulated bus bar holder 51 which, in turn, is supported by lifting frame 52. The lifting frame is attached to lifting bar 48 which is connected to lifting arm 53 by a suitable connecting means. Lifting arm 53 is also suitably connected to eccentric bearing assembly 43. Lifting arm 53 is adjustable in length.

During operation, as shaft 45 rotates, eccentric bearing assembly 43 causes lifting arm 53 to cylically raise and lower lifting bar 48, lifting frame 52 and bus bar holder 51. The raising and lowering of bus bar holder 51 also raises and lowers anode bus bar 8 and cathode bus bar 17. Since anode 4 and cathode 2 are attached to their respective bus bars, they also raise and lower together with lifting frame 52.

It is also considered part of the present invention to modify the hereinabove described lifting elements so as to be able to raise and lower only the cathode, only the anode, or independently of each other, both the anode and cathode. Such modification of the hereinabove described lifting and lowering elements is within the skill of those practicing this art.

For anode only agitation, this cyclical motion of raising and lowering anode 4, at a proper frequency, is sufficient to prevent the formation of gas bubbles on anode 4 which prevents a polarization voltage from being established by the gas bubbles. This lack of polarization voltage, in turn, further lowers the voltage of the cell and allows for a higher current density than in a conventional cell that consumes the same power. Agitation of only the anode to reduce overall cell voltage in electrolytic cells without diaphragms is considered to be part of the present invention.

In one embodiment of the cell, a non-conducting coarse mesh member 16 (see FIG. 2) is provided with sufficient length to extend the electrically active length of the upwardly and downwardly oscillating cathode 2. This mesh member 16 is maintained in a fixed position adjacent the inside surface of diaphragm 3, which causes the dendritic crystals to break off when they are mechanically engaged against the fixed mesh member 16 by the raising and lowering of cathode 2. The metal crystals thus broken off fall to the bottom of tank 11 where they are collected by a moving conveyor belt (not shown), as hereinbefore discussed. The openings in the mesh member 16 are less in dimension than the total movement of cathode 2 during its raising and lowering motion.

In an alternate embodiment of the cell, the mesh member 16 and diaphragm 3 may be cyclically raised and lowered while the cathode is fixed to achieve the same effect of breaking off portions of the metal crystals for collection. In a further alternate embodiment of the cell, wherein a fixed diaphragm 3 is required, mesh member 16 may still be employed to break off part of the metal crystals through cyclical motion of either, cathode 2 with mesh member 16 fixed or, mesh member 16 with cathode 2 fixed.

Motor 50 and gear box 47 may be selected such that the rate of oscillation (rising and falling of lifting frame 52) is between 95 and 150 cycles per minute. This oscillation frequency range is rapid enough to prevent a polarization voltage but slow enough to allow for good dendritic crystalline growth. The resulting agitation of the anolyte and catholyte liquid when both the anode and cathode are raised and lowered provides a mixing effect and thus prevents stratification of the liquid around cathode 2 and anode 4. The further mixing of anolyte when passing between anode 4 and diaphragm 3, decreases the evolution of chlorine and further prevents the formation of stagnant zones. These mixing effects provide more uniform concentration of anolyte and catholyte resulting in a more consistent and higher quality of product over the entire length of cathode 2 than the product found on a conventional plate cathode. Further, such mixing, in combination with a reduced polarization voltage at the anode 4, also serve to allow embodiments of the cell to successfully operate and electrowin group I B and II B transition metals from a catholyte solution containing compounds of such metals at concentrations below those for which a conventional plate cell can successfully electrowin such metals.

In a conventional electrowinning apparatus having many plate cells in series and employing a chloride process to recover copper, the fresh catholyte solution entering the apparatus has a copper concentration of about 7%. The spent catholyte leaving the apparatus and then becoming fresh anolyte has a copper concentration of about 3.5%. As described hereinbefore, this is to allow the chloride ion to assist in dissolution of the metal from its ore or ore concentrates. Thus, the lower or "half" value of concentration of metal may be selected to be near the lower operable metal concentration of the electrowinning apparatus to avoid the expense and problem of having to enrich the concentration of the desired metal relative to naturally occurring concentrations of the metal in its ore. However, even at 3.5% copper concentration, the last few plate cells may produce a copper product that is unsuitable for direct uses without further processing because of stratification or other flow type problems in these last few cells, or possibly even the cells before these last few cells.

However, when the prototype cell described later herein was employed to electrowin copper using a chloride process, the cell was also found to be capable of producing a superior dendritic copper product at reduced copper concentrations in the catholyte. This prototype cell is thus able to successfully electrowin copper at copper concentrations employed in plate cells, but with a higher quality product more evenly distributed along the cathode. This prototype cell is also able to successfully electrowin copper at copper concentrations below this range down to as low as substantially 0.5% copper. Further, this prototype cell was able to produce a useful copper product to a copper concentration as low as 0.1% without evolution of hydrogen and as low as 0.05% with some evolution of hydrogen.

This is in contrast to a conventional plate cell employing a chloride process which is only capable of electrowinning a useful copper product at concentrations as low as about 4% to 3.5%. Moreover, conventional plate cells employing a chloride process to recover copper normally utilize a catholyte having a copper concentration of from about 7% to about 3.5%, as discussed hereinabove. Thus, this prototype may successfully operate in the same concentration ranges as plate cells or it may operate in concentration ranges below those able to be employed by plate cells. This will further reduce any need to enrich the metal concentration relative to natural ore concentrations.

Experimentation with the operating parameters of the prototype cell demonstrated that the operation of the prototype cell at these extremely low concentrations was also at a lower power than that required by a conventional plate cell. Specifically, the effective current employed in the prototype cell for these low concentrations was about half the normal current of 80,000 amps which is customarily used to electrowin copper and which is also about the same current normally employed in a conventional plate cell to electrowin copper using a chloride process. As discussed hereinafter, the power consumed by the prototype cell even at normal current is less than that consumed by a plate cell because of the reduced cell voltage in embodiments of this cell.

It is presently theorized and believed that the successful operation of embodiments of this cell at such low concentrations is due to the reduced polarization voltage, and the superior mixing effects and intimate contact between the cathode and catholyte and anode and anolyte, as well as the individual feed of catholyte to each cathode.

Thus, the embodiments of this cell may be used to effectively strip substantially all of the aforementioned groups of metals from the catholyte at a very low power and eliminate the use of holding tanks to precipitate out any such metals remaining in the spent catholyte solution to be discarded after a conventional electrowinning process.

The amount of upward travel of lifting frame 52 is predetermined by the displacement of the eccentric cam frame during a rotation of the shaft. The operable stroke is about 1/16 of an inch to about one inch. The mesh opening dimension should be no greater than the stroke length.

In an embodiment of the cell employed to recover copper using a chloride process, the cathode 2 is preferably made from commercially available copper tubing and the anode 4 may be a commercially available graphite rod. The diaphragm may be commercially available Teflon, polyethylene, polypropylene and polyacrylic, all of suitable texture including felted, woven, needled, or gas expanded, and processed as required to obtain the desirable limited permeability to solution flow, together with minimal electrical resistance. Polypropylene plastic, cut and formed into a cylinder, is presently preferred as the diaphragm material. Mesh member 16 may also be made of polypropylene plastic and is retained within diaphragm 3 by suitable adhesive or attaching means.

A prototype cell was constructed for a laboratory test of an embodiment of the present invention for the recovery of copper using a chloride process. The cell utilized a commercially available copper tube that was $2\frac{1}{8}$ inch outside diameter and 48 inches long, as its cathode 2. Anode 4 was a commercially available graphite heat exchanger pipe that was $2\frac{3}{4}$ inch outside diameter and 2 inch inside diameter, with a length of 2 inch inside diameter copper tubing inserted into the graphite pipe; this was accomplished by making a slot the length of the 2 inch copper tubing, compressing the tubing slightly and inserting the tubing into the graphite pipe where it re-expands to form an electrical contact with the graphite pipe.

Anode 4 was constructed in this manner to allow anode 4 to be welded to bus bar 8 by the copper tubing instead of being bolted to bus bar 8, as the bolts have a tendency to corrode and thus require continuing maintenance.

Diaphragm 3 of the prototype cell was made of polypropylene plastic, as was mesh member 16, which was attached to it. The diameter of diaphragm 3 was 4 inches.

The cell voltage of the prototype cell, using the chloride process, was found to be about 1.8 volts, which is much less than the approximate 7 to 8 volts of a comparable conventional plate cell, using the chloride process. Thus, even when the prototype cell uses operating currents comparable to a conventional plate cell, the prototype cell consumes less power because of its reduced cell voltage.

The prototype cell was continuously agitated at about 128 cycles per minute and had an agitation travel of about $\frac{1}{2}$ inch. Experimentation with the frequency of agitation showed that below about 95 cycles per minute anode 4 experiences a polarization voltage of approximately 0.5 volts. Above 95 cycles per minute this polarization voltage is either substantially reduced or eliminated. The lowering of the frequency of agitation did not affect the dendritic crystal growth on cathode 2 and it is believed that a lower frequency of cathode agitation could be employed when cathode 2 is agitated separately from anode 4.

Experimentation with intermittent agitation of only cathode 2 resulted in a preferred agitation to non-agitation ratio of about 30 seconds of agitation about every 15 minutes. The frequency of agitation may be any convenient frequency that is suitable to break off a part of the crystals from the cathode. It is also possible to agitate only mesh member 16 to achieve the same effect as if separate agitation of cathode 2 were employed. With either mode of operation, the relative movement of mesh member 16 with respect to cathode 2 produces agitation of the catholyte and mechanical dislodging of the dendrites.

The prototype cell was operated for a period of about four months and produced superior quality dendritic copper crystals at a much lower voltage and power than any conventional plate cell. The prototype cell was operated at approximately 65°–80° C. and did not exhibit appreciable chlorine or other gas evolution.

Many other variations and modifications may be made in the apparatus and techniques hereinbefore described, by those having experience in this technology, without departing from the concept of the present invention. Accordingly, it should be clearly understood that the apparatus and methods depicted in the accompanying drawings and referred to in the foregoing description are illustrative only and are not intended as limitations on the scope of the invention.

What is claimed is:

1. A process for electrolytically producing a particulate crystalline metal product having limited adherence to the surface of a cathode, comprising:

providing a cathode, an anode, a diaphragm spaced from said cathode and disposed between said cathode and anode, and a mesh member disposed adjacent the surface of said diaphragm nearest said cathode, and agitating said mesh member relative to said cathode to effectively influence and contribute to the control of crystalline product size and density as well as the structural integrity of crystalline dendrites and to dislodge a portion of the dendritic growths from said cathode by engaging said mesh member with said growths.

2. A process for electrolytically producing a particulate crystalline metal product having limited adherence to the surface of a cathode, comprising:

providing cathode, an anode, a diaphragm spaced from, said cathode and disposed between said cathode and anode, and a mesh member disposed adjacent the surface of said diaphragm nearest said cathode, and agitating said cathode relative to said mesh member to effectively influence and contribute to the control of crystalline product size and density as well as the structural integrity of crystalline dendrites and to dislodge a portion of the dendritic growths from said cathode by engaging said growths with said mesh member.

3. A process for electrolytically producing a particulate crystalline metal product having limited adherence to the surface of a cathode, comprising:

providing a vertically elongated cathode, at least one vertically elongated anode spaced from said cathode, and a vertically elongated permeable diaphragm disposed between said cathode and anode having a mesh member disposed adjacent the surface of said diaphragm nearest said cathode, agitating said anode to substantially reduce the polarization voltage of said anode, and agitating said cathode relative to said mesh member to effectively influence and contribute to the control of the crystalline product size and density as well as the structural integrity of crystalline dendrites and to dislodge a portion of the dendritic growths from said cathode by engaging said growths with said mesh member.

4. A process for removing a metal from an electrolyte by electrolytically producing a particulate crystalline product of said metal having limited adherence to the surface of a cathode, comprising:

providing a cathode, an anode, a diaphragm spaced from said cathode and disposed between said cathode and anode, and a mesh member disposed adjacent the surface of said diaphragm nearest said cathode, agitating said cathode relative to said mesh member to effectively influence and contribute to the control of crystalline product size and density as well as structural integrity of crystalline dendrites and to dislodge a portion of the dendritic growth from said cathode by engaging said growths with said mesh member, wherein said electrolyte contains said metal at a concentration ranging from substantially 3.5% to substantially 0.05%, by weight.

5. A process for removing a metal from an electrolyte by electrolytically producing a particulate crystalline product of said metal having limited adherence to the surface of a cathode, comprising:

providing a vertically elongated cathode, at least one vertically elongated anode spaced from said cathode, and a vertically elongated permeable diaphragm disposed between said cathode and anode having a mesh member disposed adjacent the surface of said diaphragm nearest said cathode, agitating said anode to substantially reduce the polarization voltage of said anode, and agitating said cathode relative to said mesh member to effectively influence and contribute to the control of the crystalline product size and density as well as the structural integrity of crystalline dendirites and to dislodge a portion of the dendritic growths from said cathode by engaging said growths with said mesh member, wherein said electrolyte contains said metal at a concentration ranging from substantially 3.5% to substantially 0.05% by weight.

6. An apparatus for performing electrolysis, comprising:

first tank means for containing anolyte;

a vertically elongated anode;

anode supporting means for supporting said anode in the first tank means;

at least two vertically elongated cathodes adjacent to said anode, said cathodes being spaced from each other;

at least two vertically elongated permeable diaphragms for containing catholyte, each said diaphragm being positioned between one of said cathodes and said anode;

cathode supporting means for supporting each said cathode within one of said diaphragms;

said apparatus being adapted for depositing loosely adhering copper crystals from said catholyte upon each said cathode and wherein said catholyte contains a copper salt;

a mesh member disposed adjacent the surface of each diaphragm nearest the cathode positioned therein; and a displacing means and a supporting means acting in conjunction with said displacing means to displace said cathode a predetermined distance in a substantially vertical direction relative to said mesh member at a predetermined frequency to dislodge said loosely adhering copper crystals from said cathode by engaging said crystals with said mesh member.

* * * * *